US007545284B2

(12) United States Patent
Neumann et al.

(10) Patent No.: US 7,545,284 B2
(45) Date of Patent: Jun. 9, 2009

(54) SIGNALING APPLIANCE, IN PARTICULAR A SIGNALING COLUMN

(75) Inventors: Siegfried Neumann, Wehingen (DE); Dirk Rothhaas, Donaueschingen (DE); Ronny Lauer, VS-Obereschach (DE)

(73) Assignee: WERMA Signaltechnik GmbH & Co. KG, Rietheim-Weilheim (DE)

( * ) Notice: Subject to any disclaimer, the term of this patent is extended or adjusted under 35 U.S.C. 154(b) by 256 days.

(21) Appl. No.: 11/253,553

(22) Filed: Oct. 20, 2005

(65) Prior Publication Data

US 2006/0089017 A1 Apr. 27, 2006

(30) Foreign Application Priority Data

Oct. 22, 2004 (DE) ..... 10 2004 051 675
Dec. 10, 2004 (DE) ..... 10 2004 059 875

(51) Int. Cl.
*G08B 21/00* (2006.01)

(52) U.S. Cl. ..... 340/641; 340/686.1; 340/669; 340/693.9

(58) Field of Classification Search ..... 340/641, 340/686.1, 679, 665, 540, 669; 73/649, 651; 310/311, 314, 318, 300; 361/600, 679, 719, 361/718; 439/626, 660
See application file for complete search history.

(56) References Cited

U.S. PATENT DOCUMENTS 4,580,203 A * 4/1986 Betsch et al. ..... 362/294
5,952,915 A * 9/1999 Marquardt et al. ..... 340/332
6,176,706 B1 * 1/2001 Maeno et al. ..... 439/56
6,179,208 B1 * 1/2001 Feng ..... 235/472.01
6,514,105 B2 * 2/2003 Lin ..... 439/699.2
6,547,430 B2 * 4/2003 Dinant ..... 362/547
6,632,003 B2 * 10/2003 Marquardt et al. ..... 362/267
7,131,791 B2 * 11/2006 Whittaker et al. ..... 405/184.2
7,230,532 B2 * 6/2007 Albsmeier et al. ..... 340/539.26
2004/0025390 A1 2/2004 Warren et al.
2004/0168359 A1 9/2004 Cleaver et al.

FOREIGN PATENT DOCUMENTS

DE 195 13 983 A1 10/1995
EP 1 146 280 A2 10/2001
EP 1 347 233 A2 9/2003
WO WO 2004/113789 A1 6/2004

* cited by examiner

*Primary Examiner*—Benjamin C Lee
*Assistant Examiner*—Daniel Previl
(74) *Attorney, Agent, or Firm*—Breneman & Georges

(57) ABSTRACT

A signaling appliance is provided, in particular a signaling column for indication of at least one operating state of a technical appliance such as a machine, an installation, a vehicle or the like, having at least one holding apparatus (5) for holding an electrical light-emitting element, in particular an incandescent lamp, which can be produced at a lower cost and/or provides further application options, in which case the electronics mount can be installed very easily, for example for commercially available signaling elements and/or bulbs. According to the invention, this is achieved in particular in that the holding apparatus (5) which is provided for holding the electronics mount (9) is also designed to hold the signaling element (7), with the holding apparatus (5) having at least one guide apparatus (8) for lateral guidance of the electronics mount (9) to be installed.

20 Claims, 4 Drawing Sheets

A-A

A-A

A-A

SIGNALING APPLIANCE, IN PARTICULAR A SIGNALING COLUMN

BACKGROUND OF THE INVENTION (1) Field of the Invention

The invention relates to a signaling appliance, in particular a signaling column for indication of at least one operating state of a technical appliance, such as a machine, an installation, a vehicle or the like, having at least one holding apparatus for holding an electrical signaling element, in particular an incandescent lamp. More particularly the invention pertains to a signaling appliance having a holding apparatus that is also designed to optionally hold an electronics mount with the holding apparatus having a least one guide apparatus for lateral guidance of the electronics mount to be installed.

(2) Description of Related Art Including Information Disclosed Under 37 CFR 1.97 and 1.98

Signaling appliances, in particular signaling columns, are widely used for indication of operating states of technical appliances, such as machines, installations or vehicles. In particular, they are used to signal, in particular visually and in some cases also audibly, disturbances in the operation of such machines or installations, so that the operator is able to identify and to overcome such disturbances. Furthermore, signaling appliances such as these can also signal operating states which result in hazards to the surrounding area and/or to people in the surrounding area.

In order as far as possible to make full use of the capacity of machines or installations, they are relatively frequently used in a continuous operating mode. In many manufacturing concerns, such machines run essentially fully automatically, so that only a very small number of operating and monitoring personnel are provided. In this case, it is impossible to avoid the possibility of individual machines or installations not being monitored at times, so that it is possible for unidentified disturbances in operation to occur with the negative accompanying phenomena associated with this, such as an operating shut-down, or even hazardous situations.

Appropriate signaling appliances and signaling columns are already commercially available in widely differing variants, in order as far as possible to have the capability to be matched to a wide range of requirements. Signaling columns having a plurality of individual modules which can be plugged together are frequently used, in which case, by way of example, a basic or base module, a green, red, yellow, blue and/or white signaling or light-emitting module, and/or an acoustic signaling module with a piezo buzzer or the like are provided.

Furthermore, it is already normal commercial practice for light-emitting modules to have an incandescent lamp, one or more light-emitting diodes or flashlights as a light-emitting element.

This large number of variants require numerous different module versions. Modules with bulbs, modules with LEDs, modules with buzzers, modules with flashlights etc. In accordance with this, a large number of different modules must be produced, stored and managed, which on the one hand reduces the quantities of identical modules and on the other hand increases the complexity and, in the end, the costs for the manufacturer of corresponding signaling appliances.

One object of the invention is to propose a signaling appliance, in particular a signaling column for indication of at least one operating state of a technical appliance such as a machine, an installation, a vehicle or the like, having at least one holding apparatus for holding an electrical signaling element, in particular an incandescent lamp, which can be produced at lower cost and/or creates further application options, wherein, in particular, the installation of the electronics mounts, for example in the case of commercially available signaling elements or bulbs, can be carried out very easily.

BRIEF SUMMARY OF THE INVENTION

Against the background of a signaling appliance of the type mentioned in the introduction, this object is achieved in particular by having a signaling appliance with a holding apparatus that is also designed to optionally hold an electronics mount with the holding apparatus having at least one guide apparatus for lateral guidance of the electronics mount to be installed. Additional advantages of the invention can be obtained where the optional signal element and the optional electronics mount have different holding elements, or where the guide apparatus is designed so that the electronics mount can be plugged into the holding apparatus or where the guide apparatus is a slot open on at least one side, or where the slot is aligned in the axial direction of the signaling appliance, or where the slot is open on the side of the holding apparatus which is arranged opposite a base, or where the electronics mount is broader than the holding apparatus, or where the width of the electronics mount substantially corresponds to the unobstructed width of the signaling appliance cross section, or where the electronics mount has at least one light emitting diode, or where at least one fixing unit is provided for fixing the signaling element and/or the electronics mount, or where the fixing unit is a latching unit for latching the signaling element and/or the electronics mount, or where the fixing unit has at least one bayonet fitting for fixing the signaling element and/or electronics mount, or where identical connections can be used for the power supply and/or for interchanging data both for the signaling element and the electronic mount, or where the connections are spring contacts, or where the electronics mount has at least one transmitting unit with a transmitter and/or receiver for wire-free data transmission to a receiver and/or from a transmitter, or where the electronics mount has at least one bus coupler, or where the electronics mount has at least one sensor for recording a parameter, or where a printed circuit board has at least one recording unit for recording an image and/or moving images or where an electrical tone generator is provided to produce tones.

A signaling appliance according to the invention is accordingly distinguished primarily in that the holding apparatus is also designed to optionally hold an electronics mount with the holding apparatus having at least one guide apparatus for lateral guidance of the electronics mount to be installed. This measure makes it possible to produce a single multifunctional holding apparatus or base for widely differing or potential applications and/or for widely differing elements to be held. For example, incandescent lamps, in particular with a round base, or advantageously largely planar or at least partially curved electronics mounts or printed circuit boards, in particular also including flexible printed circuits or conductor sheets, ceramic mounts etc., can be selectively held by a single holding apparatus according to the invention. The electrical electronics mount or the printed circuit board may provide virtually any desired functionalities and may have virtually any desired actuators and/or sensors.

According to the invention, a single holding apparatus and/or signaling module is advantageously produced, stored and managed and can be used together with a light-emitting element or with an electronic circuit or printed circuit board, depending on the purpose. This considerably increases the quantities of corresponding holding apparatuses and/or correspondingly equipped signaling appliances or signaling columns which can be produced, in particular the quantities of modules according to the invention for signaling columns.

In particular, the guide apparatus for lateral guidance of the electronics mount to be installed allows comparatively simple installation and, at the same time, advantageous holding of the electronics mount or of the printed circuit board. During the installation process, the electronics mount is advantageously guided at least in places on the guide apparatus until it reaches the holding position. In the holding position, the guide apparatus can advantageously hold or even fix the electronics mounts, for example by means of at least one stop surface which the electronics mount strikes, in particular in the lateral direction.

The signaling element which can optionally be used and the electronics mount which can optionally be used advantageously have holding elements of different design. This makes it possible to provide for optional holding of the components which are generally a very different design, that is to say the signaling element or electronics mount, in an elegant manner, and to achieve this without major complexity. For example, a screw thread may on the one hand be provided as a holding element for a signaling element which is in the form of an incandescent bulb, while a bayonet fitting may be provided on the other hand for the electronics mount or the like, in which case the holding apparatus can be used for both types of elements to be held.

The guide apparatus is preferably designed such that the electronics mount to be installed can be inserted in a guided manner into the holding apparatus. In this case, it is particularly advantageous for at least the electronics mount to be installed such that it can be plugged in, with the direction of insertion advantageously running along the guide surface of the guide apparatus. The electronics mount can be inserted particularly easily.

By way of example, the guide apparatus is, in particular, in the form of a recess, gap, slot, groove or the like. In one particular variant, the guide apparatus has projections such as studs, tabs or the like, past which the electronics mount can be guided during installation.

The guide apparatus is advantageously in the form of a slot which is open on at least one side. In particular, this means that the circumference of the holding apparatus is not completely closed, but is interrupted at least once, and preferably twice. By way of example, two slots are arranged on opposite sides of the holding apparatus. This makes it possible, for example, for a planar printed circuit board or the like to pass through the holding apparatus in an advantageous manner, with some areas of the printed circuit board possibly projecting beyond the holding apparatus, or overhanging it. Inter alia, this can also lead to the extent of the electronics mount not being restricted by the extent of the holding apparatus. The width of the electronics mount can accordingly be greater than the width of the holding apparatus.

It is feasible for the slot to have a curved guide surface along which, in particular, flexible conductor sheets or the like can be guided or wound. If required, the slot is aligned transversely with respect to the longitudinal direction of the signaling appliance, so that the electronics mount or the printed circuit board is aligned transversely with respect to the longitudinal axis of the signaling appliance or of the signaling column.

The slot is preferably aligned essentially in the axial direction of the signaling appliance. This allows the electronics mount or the printed circuit board to be installed in a particularly simple manner, such that it can be moved or plugged in in the axial direction.

In one preferred variant of the invention, the slot is open on that side of the holding apparatus which is arranged opposite a base. This variant of the invention advantageously allows axial installation of the signaling element or of the electronics mount. In the prior art, the signaling elements, in particular the incandescent lamps, are installed axially, with the signaling appliance already being designed for this type of installation.

By way of example, a signaling appliance and/or a signaling module has a radially closed casing surface and a base, with a side which is arranged opposite the base advantageously being very largely open. The signaling element or, optionally, the electronics mount can be installed in an advantageous manner through this opening in the module or in the signaling appliance. This installation opening in the signaling appliance or in the signaling module can be closed by means of a cover element, and/or by a further signaling module.

In one advantageous embodiment of the invention, the width of the electronics mount, in particular in the transverse direction with respect to the longitudinal axis, corresponds essentially to the unobstructed width of the signaling appliance cross section. This makes it possible to provide a particularly large-area embodiment of the electronics mount or of the printed circuit board. This allows a particularly large number of electronics components to be used and to be arranged on the electronics mount. If required, the length of the electronics mount in particular in the longitudinal direction of the signaling appliance corresponds essentially to the unobstructed length of the signaling appliance or of the signaling module.

The electronics mount or the printed circuit board preferably has at least one, and in particular two or more, light-emitting diodes. This makes it possible, for example, for the holding apparatus to be optionally equipped with the signaling element, such as an incandescent lamp, or with an LED as the light source. The plurality of LEDs are advantageously arranged so as to produce illumination over virtually all of the surrounding area, or 360'. For example, an arrangement of at least four LEDs with a cruciform cross section is envisaged.

In one preferred embodiment of the invention, the holding apparatus in particular has at least one fixing unit for fixing the light-emitting element and/or the electronics mount, or the printed circuit board. The fixing ensures that the element to be held or to be fixed, such as the incandescent lamp or the electronics mount or the printed circuit board, as far as possible cannot become loose on its own during operation. For example, the signaling element and/or the electronics mount is installed or inserted in an installation direction, and is fixed in the opposite direction or in the dismounting direction with the aid of the advantageous fixing apparatus.

It is feasible for the fixing apparatus to be in the form of a clamping apparatus for clamping the signaling element and/or preferably the electronics mount or the printed circuit board. For example, the slot is designed to taper so as to make it possible to advantageously provide clamping by virtue of the installation or insertion movement.

By way of example, the holding apparatus has at least one screw thread for fixing of the signaling or light-emitting element. This allows, for example, incandescent lamps, buzzers or the like with a screw cap to be fixed very easily, and to be detached again when required. A correspondingly designed holding apparatus has, for example, one or two slots and/or interruptions in the threaded cap for holding the electronics mount or the printed circuit board, into which the electronics mount or the printed circuit board can be inserted.

The fixing unit is advantageously in the form of a latching unit for latching of the signaling or light-emitting element and/or of the electronics mount or of the printed circuit board. The latching of the elements to be held provides particularly simple and effective fixing. By way of example, at least one latching tab is provided, which has to be passed over during fixing and effectively prevents unlatching or detachment of the signaling or light-emitting element and/or of the electronics mount or of the printed circuit board on their own.

The fixing unit preferably has at least one bayonet fitting for fixing of the signaling or light-emitting element and/or of the electronics mount or the printed circuit board. A bayonet fitting is already commercially available, in particular for light-emitting elements or incandescent lamps, so that this variant of the invention makes it possible to make use of standardized components.

Furthermore, a bayonet fitting ensures that the corresponding elements are securely fixed. In general, a direction change is provided in the movement process for fixing with a bayonet fitting. For example, linear movement or insertion in the axial direction is provided, with rotation, in particular subsequent rotation, about the axial axis.

In one advantageous variant of the invention, the fixing unit has a first bayonet fitting for fixing of the signaling or light-emitting element, and a second bayonet fitting for fixing of the electronics mount or the printed circuit board. This allows both the signaling or light-emitting element and the electronics mount or the printed circuit board to be fixed easily but effectively by means of the holding apparatus according to the invention.

At least in some cases, identical electrical connections can preferably be used for the power supply and/or for interchanging data both for the signaling and light-emitting element and for the electronics mount or the printed circuit board. This makes it possible to reduce the number of components to be provided, thus making it possible to achieve a further cost reduction during production.

In one particular development of the invention, the fixing apparatus for the signaling element and the guide apparatus and/or the slot or slots are arranged or designed in particular being rotated through 90°, such that standard incandescent bulbs, in particular with a bayonet fitting, and the end contacts of the electronics mount or of the printed circuit board can make contact with the same connections.

The connections are advantageously in the form of spring contacts, in particular spring strip contacts or the like. This ensures that contact is made simply and reliably with the elements to be held.

In general, a signaling appliance in particular a signaling column for indication of at least one operating state of a technical appliance such as a machine, an installation, a vehicle or the like, having at least one holding apparatus for holding an electrical signaling element in particular an incandescent lamp achieves the object according to the invention in an advantageous manner, with the signaling appliance having at least one functional unit with at least one actuator and/or sensor, in particular with at least one electrical circuit on an electronics mount or a printed circuit board. This allows the signaling unit to be provided with virtually any desired functionality. This can allow completely new application options for signaling appliances according to the invention.

Different functional modules are advantageously combined, for example in a signaling column. Corresponding actuators and/or sensors may, for example, be designed as described in more detail in the following text.

The actuator, the electronics mount or the printed circuit board advantageously has at least one transmitting unit with at least one transmitter and/or receiver for wire-free data transmission for a receiver and/or transmitter. These variants of the invention make use of the fact that the corresponding machines, installations, vehicles or the like have an interface to the signaling appliance in any case, since the signaling appliance is normally intended to produce a visual or audible signal for indication of the desired operating state. Furthermore, a conventional signaling appliance such as this already has a controller for production of such signals. The invention makes use of this fact in order, for example, by means of the additional transmitter for wire-free data transmission, to produce a mobile receiver which, for example, can be carried by someone carrying out a control or monitoring function which is located a long distance away, possibly even outside the company site. No modifications whatsoever are required for this purpose at the end which the technical appliance to be monitored is located.

In the variant of the invention in which the signaling appliance or the signaling module has a receiver, it is possible, by way of example, to receive signals without the use of wire, and for these signals to be made available to the appliance, to the machine or to the installation, and to be used to monitor, in particular to control it, in advantageous manner. No modifications whatsoever are required for this purpose at the end at which the technical appliance to be monitored is located.

In one advantageous development of the invention, the transmitter and/or the receiver is in the form of a subscriber to a public communications network. This means that there is no need for any data transmission path to be set up separately.

Furthermore, an additional transmission unit can be provided in the data transmission path between the transmitter and receiver. A transmission unit such as this may be used as an interface to a public communications network. The communications network may in this case be in the form of a wire-free radio network and/or a landline cable network. The only important factor in this exemplary embodiment is the wire-free connection between the transmitter for the signaling appliance and the transmission unit in the transmission path between the transmitter and receiver. One development of the embodiment described above includes operation of a plurality of transmitters for one or more signaling appliances using one and the same transmission unit. A configuration such as this can be produced without any problems using digital data transmission channels, making it possible to avoid the complexity of a plurality of transmission units.

In one particularly advantageous embodiment of the invention, the transmitter and/or the receiver for the signaling appliance are/is in the form of a replaceable module. It is thus possible to always equip only a selection of machines or installations with a transmitter according to the invention, with considerably reduced investment costs.

In one particular embodiment of the invention, a landline telephone, a mobile radio telephone, a radio and/or a network subscriber and/or an Internet subscriber is provided as the receiver and/or transmitter. Fundamentally, all such communication devices are suitable for implementation of the invention. If the receiver and/or the transmitter is in the form of a radio or mobile telephone, the corresponding transmitter and/or receiver in the signaling appliance may likewise be in the form of a radio, mobile telephone or radio modem. The communication between the transmitter and/or receiver in the signaling appliance and the receiver and/or transmitter with the signal addressee, for example an operator, in this case takes place directly via the appropriate wire-free transmission path.

In the embodiment with the assistance of a landline telephone network or with the refinement of the receiver as an Internet subscriber, the transmitter and/or receiver may in this case be connected to the receiver and/or transmitter via a transmission unit as mentioned above. It is thus possible, by way of example, to provide a wire-free connection between the transmitter and/or receiver and a computer which is connected to the Intranet and/or Internet without the use of wires or via cables. The transmitter and/or receiver may also be in the form of a mobile telephone for communication with a base station which is connected to the landline telephone.

In this case, it is advantageous to use conventional standard components. For example, the transmitter and/or receiver may be in the form of a so-called DECT telephone unit, in which case the corresponding base station for the landline telephone network must be provided within the range of this DECT mobile part.

Another refinement would be to use so-called Bluetooth units, by means of which, for example, it is possible to provide a wire-free connection from a transmitter and/or receiver according to the invention to a computer in order, for example, to provide transmission via the Internet.

The signaling appliance according to the invention may, furthermore, also be provided with a transmitting and/or receiver unit which can pass on its signals by a plurality of types of transmission. It would thus be feasible, for example, without any problems to combine a mobile telephone transmitting appliance with a radio and a Bluetooth module, in order to provide different transmission channels in one transmitting or receiver unit.

The signals to be transmitted may in this case be of widely different types, depending on the application. For example, it is just as possible to provide for a transmission of a speech message as for the transmission of written messages, for example so-called SMS, etc. However, it is also feasible without any problems to transmit simpler signals, for example symbolized warning or information signals.

Furthermore, particularly in the case of digital signal transmission, it is feasible without any problems to signal various operating states of the technical appliance that is provided with the signaling appliance according to the invention. In this case, this relates not only to disturbance states but it is also possible to indicate messages about the nature of the handling or maintenance activities to be carried out, such as the need to replenish magazines, maintenance work being carried out, etc., and also to notify them as a preliminary factor, so that an appropriate person can also be called up in good time, and in particular before the occurrence of a disturbance.

Furthermore, a signaling appliance according to the invention is preferably designed such that it has both a receiver and a transmitter, for example in a single module or in separate modules. This embodiment allows interactive data transmission, that is to say an appropriate person who is carrying out a control or monitoring function can also himself send information to the signaling appliance, or can check the information there.

A signaling appliance according to the invention can also be designed such that the signal address can be entered in a freely selectable form. In this case, it is also feasible to store a plurality of signal addressees as a precaution against an emergency situation in which the desired person responsible for control or maintenance is not available. If a number of people need to be informed, then, in an embodiment such as this, they can likewise be informed at the same time or immediately one after the other by means of a signaling appliance according to the invention.

The transmitter according to the invention transmits a specific amount of electromagnetic power depending on the nature of the data transmission channel. This energy may be sufficient to itself cause disturbances in the signaling appliance. It is thus possible, for example, for LEDs, which produce a light signal, to themselves be disturbed in a sensitive manner by low radiated power levels in the order of magnitude of about 5 watts or the like. In a corresponding embodiment of the invention, the sensitive components, for example the signal transmitters (LEDs, piezo buzzers, etc.) or electronic control units are appropriately shielded from the antenna of the transmitter according to the invention, so that no interference fields, or at least no excessive interference fields, can occur in the area of the corresponding signal transmitters and/or the control electronics.

In another embodiment, the antenna is also fitted to the outside of the signaling appliance in order to ensure greater separation and better capabilities for shielding of the corresponding components in the signaling appliance.

In general, a signaling appliance according to the invention can be linked to a bus system, for example ASI, CAN, etc. In this case, addressing of the signaling appliance and/or of the individual modules is advantageous. A bus coupler is preferably arranged on the electronics mount.

The electronics mount or the printed circuit board advantageously has at least one sensor for recording a wide range of parameters. For example, the sensor may be in the form of a motion sensor, smoke sensor, gas sensor or the like.

In one particular development of the invention, the electronics mount or the printed circuit board has at least one image recording unit for recording of an image. The image recording unit is preferably in the form of a digital camera for recording digital images. For example, moving images are recorded, with the printed circuit board having, in particular, a video unit for recording of moving images. A tone recording unit is advantageously provided, for recording tones or speech. These variants of the invention make it possible to provide optical and/or acoustic monitoring of the area surrounding the signaling appliance, with advantageous signaling if required. This can be used, for example, for protection against theft and/or for protection against accidents to the operators of corresponding machines.

The printed circuit board advantageously has at least one electrical tone generator for production of tones. The tone generator is, for example, a (piezo) buzzer, a loudspeaker, a horn or the like.

BRIEF DESCRIPTION OF THE SEVERAL VIEWS OF THE DRAWINGS

One exemplary embodiment of the invention will be explained in more detail in the following text with reference to the figures, and is illustrated in the drawing, in which, in detail.

DETAILED DESCRIPTION OF THE INVENTION INCLUDING BEST MODE

Figure 1:
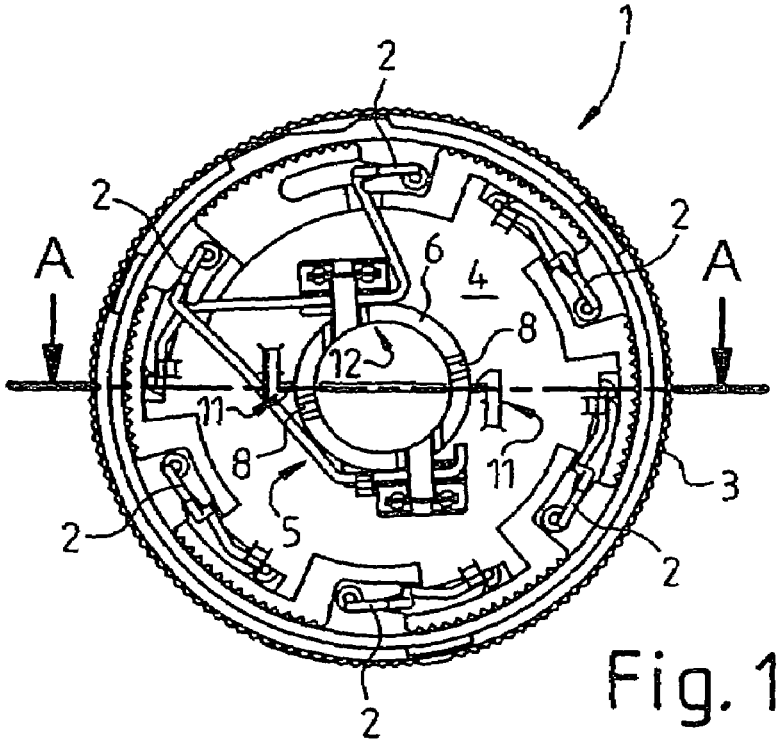
FIG. 1 shows a schematic plan view of a signaling module with a holder for an incandescent lamp and for a printed circuit board.
Figure 2:
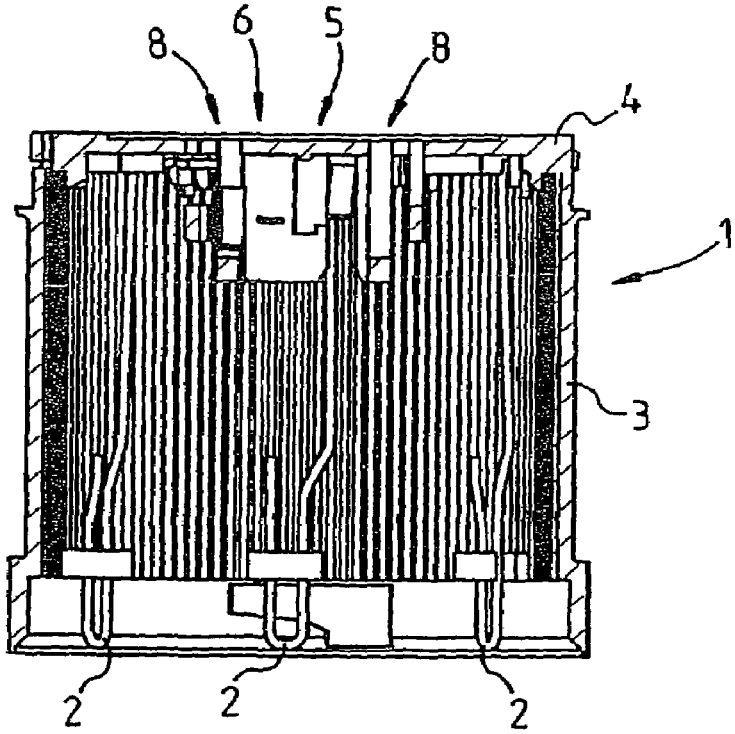
FIG. 2 shows a section along the line A-A through the signaling module shown in FIG. 1.

The figures show a module 1 of a signaling appliance, in particular of a signaling column according to the invention. The modular design of signaling columns is already prior art. The signaling appliance is a modular design with appropriate fitting mechanisms, for example a bayonet fitting, as well as the corresponding contact elements 2 for production of the electrical contacts while they are being drawn together.

By way of example, the module 1 has a colored, at least partially transparent, housing 3 that forms a corresponding cylindrical casing 3, that is advantageous for a module 1 in the form of a light-emitting module 1. The module 1 has a base element 4 which may be formed integrally with the housing 3.

Figure 3:
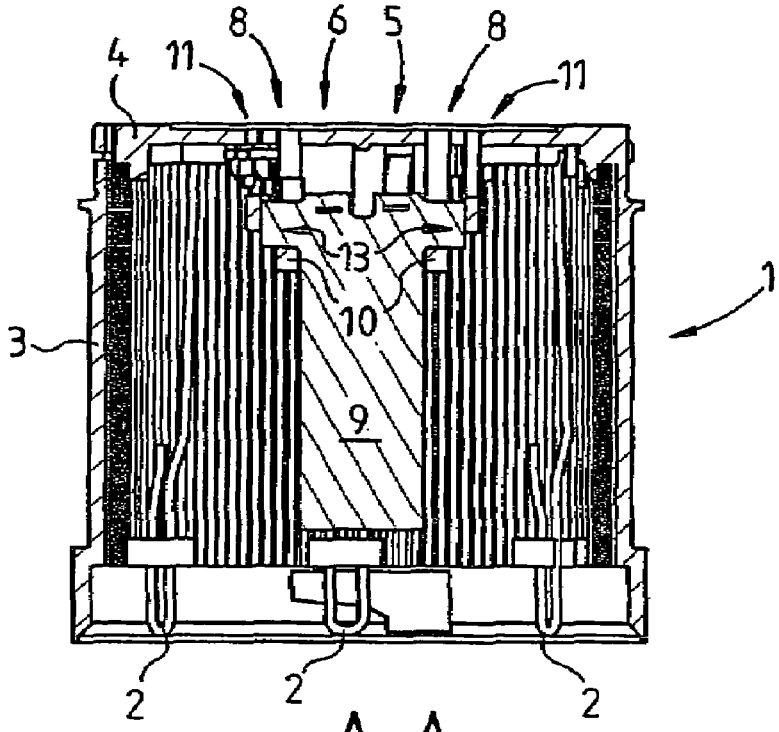
FIG. 3 shows a schematic section through a signaling module with a printed circuit board.
Figure 4:
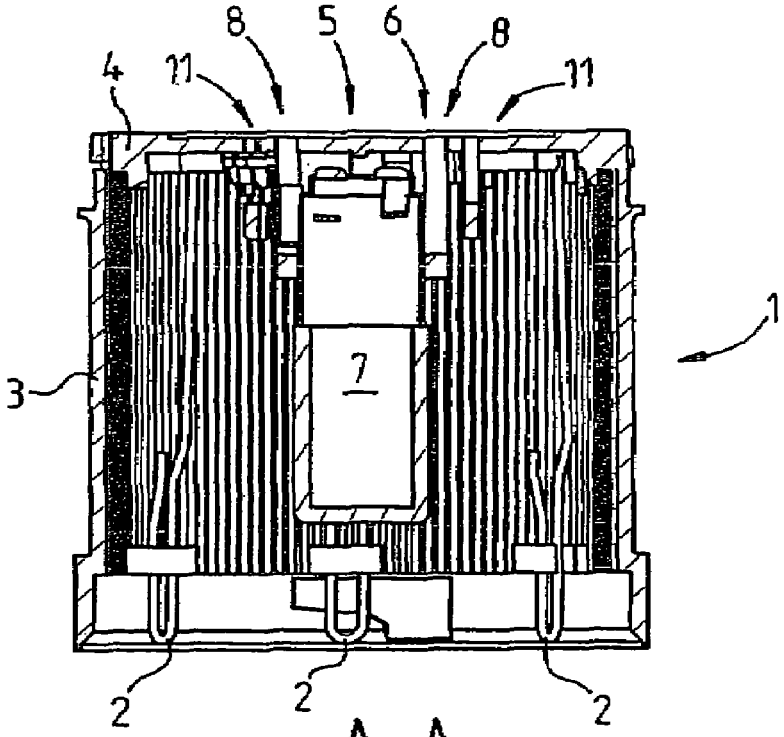
FIG. 4 shows a schematic section through a signaling module with an incandescent lamp.
Figure 5:
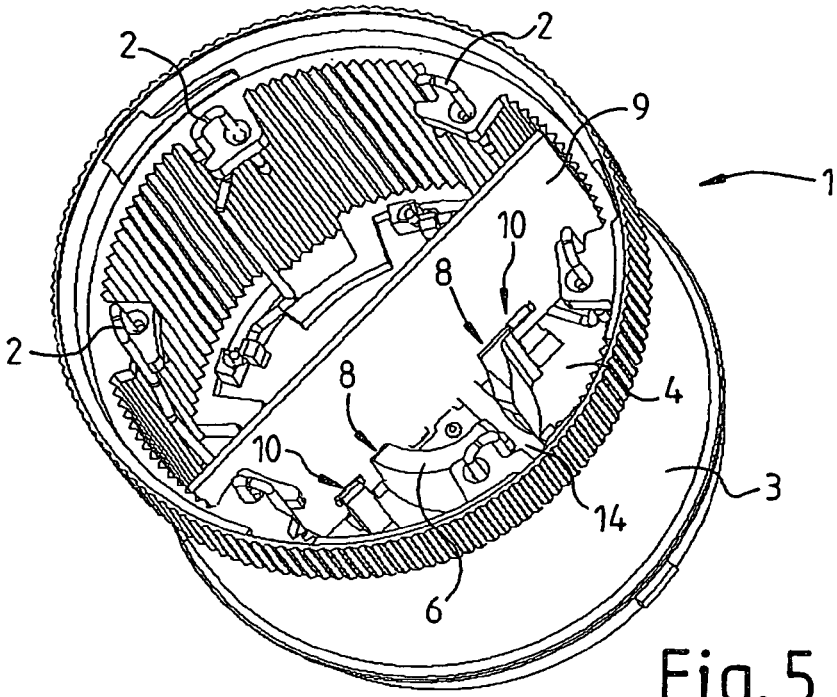
FIG. 5 shows a schematic, perspective illustration of a second signaling module with a printed circuit board.

The base element 4 has a holder 5 or a base 5, which on one side has both a round opening or recess 6 for an incandescent lamp 7 as shown in FIGS. 1 and 4, and on the other side additionally has two slots 8 or recesses or openings 8 for a printed circuit board 9 in direct contact with round opening or recess 6 as shown in FIGS. 1 and 3 to provide a combined signal opening.

In the case of the signaling module shown in FIGS. 1 to 4, the printed circuit board 9 is securely fixed, and is protected against becoming loose on its own, by means of latching tabs 10 on the holding apparatus 5 having a round signal lamp opening or recess 6 in direct contact with an electronics mount opening or recesses 8. The recesses 8 are in the form of slots 8 in the form of a bayonet fitting 8, interacting with stops 11. As can be seen clearly in the plan view shown in FIG. 1, the printed circuit board 9 is inserted at an angle to the line A-A in the direction along the rotation axis of the module 1, and is rotated about the rotation axis of the module 1 for latching and for fixing, in such a way that the printed circuit board 9 is aligned along the line A-A and strikes the stops 11.

Figure 6:
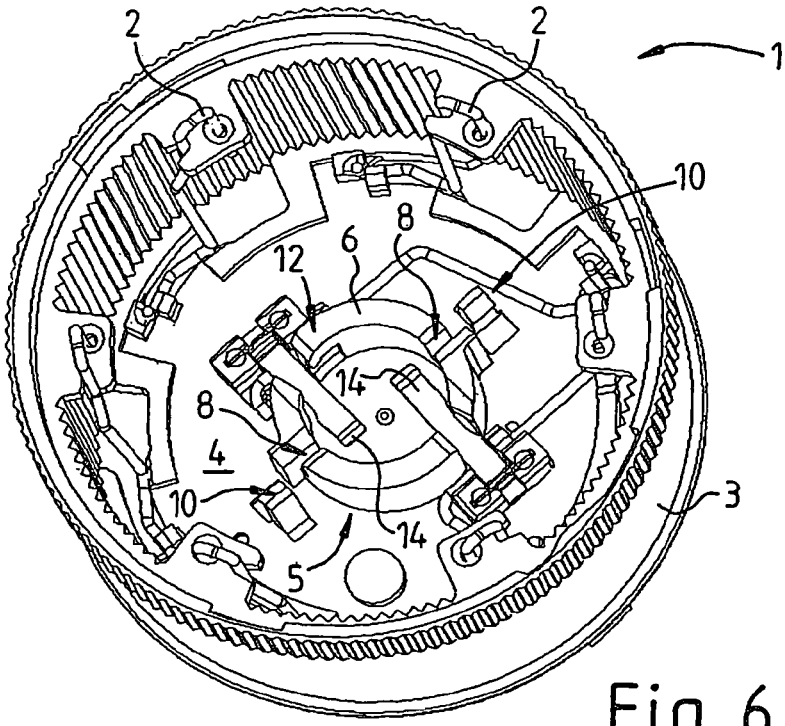
FIG. 6 shows a schematic, perspective illustration of the second signaling module with a holder for an incandescent lamp and for a printed circuit board.
Figure 7:
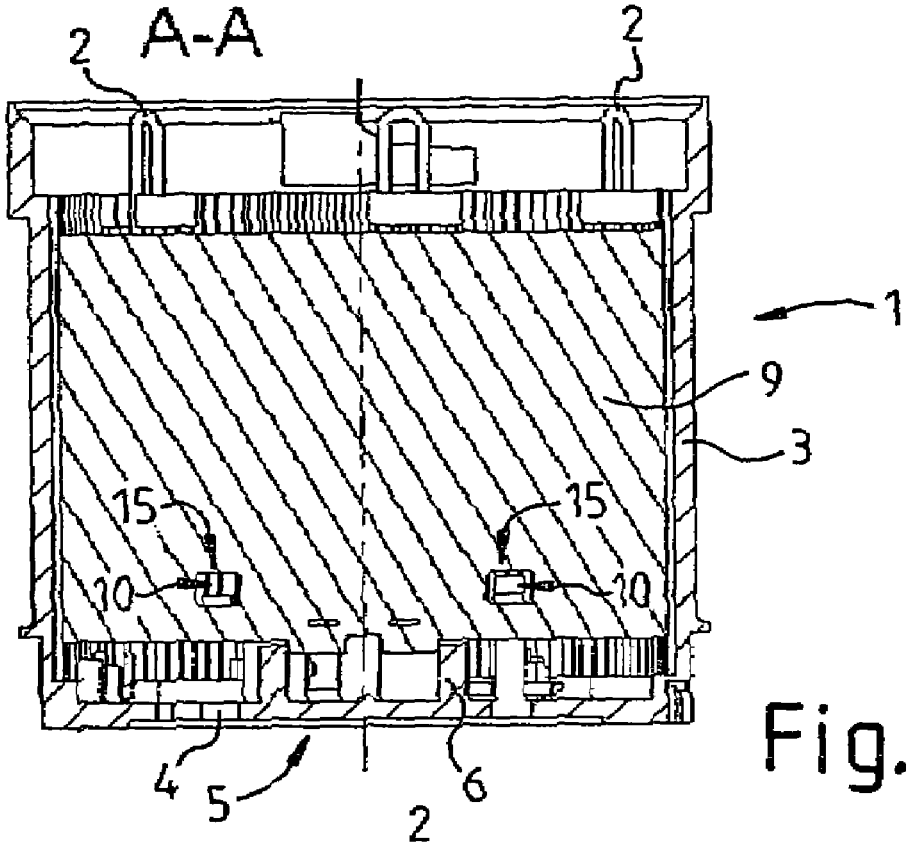
FIG. 7 shows a section along the line A-A through the second signaling module as shown in FIG. 8.

The incandescent lamp 7 shown in FIG. 4 is likewise securely fixed by means of the base 6 with a second bayonet fitting 12 (see FIG. 1 or 6). Commercially available incandescent lamps can be used in this case.

Figure 8:
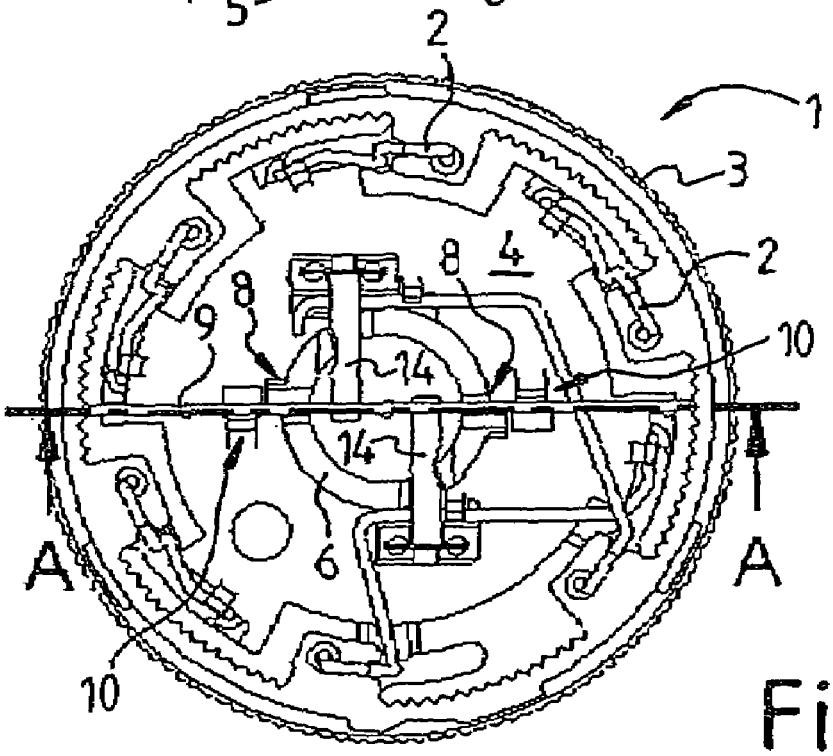
FIG. 8 shows a schematic plan view of the second signaling module with the printed circuit board.

For clarity reasons, FIGS. 1 to 4 do not show in any more detail how contact is made with the printed circuit board 9 and the incandescent lamp 7. These may both be supplied to the holder 5 just on one side or on at least two opposite sides. In this case, spring contacts 13 may be provided, as shown in FIG. 6 or 8. The electronics mount 9 or the printed circuit board 9 fits into integrated signal lamp opening 6 and electronic mount opening 8 which define the inside of surrounding holder 5 which electronic mount opening forms part of the signal lamp opening. The electronics mount 9 or printed circuit board 9 advantageously has end contents or solder attachments, in order to allow contact to be made more easily.

By way of example, the printed circuit board 9 may have a plurality of light-emitting diodes, a flash or other functional components for actuators and/or sensors, depending on the application.

The second variant of the invention as illustrated in FIGS. 5 to 8 differs from the variant shown in FIGS. 1 to 4 primarily in that the holder 5 is designed such that the printed circuit board 9 is inserted only in the axial direction, and in the process latches with latching tabs 10 which are at a distance from the base 6. There is no need to rotate the printed circuit board 9 for latching and fixing. This allows the printed circuit board 9 to be installed particularly easily and in an automated form. The corresponding handling appliance need be designed only for movement in one direction.

The recesses 8 or slots 8 are arranged on opposite sides or at an angle of 180° with respect to the base 6, so that the planar printed circuit board 9 can be fixed centrally. In this variant of the invention, the printed circuit board 9 has a width which corresponds approximately to the internal diameter of the housing 3. Furthermore, the length of the printed circuit board 9 corresponds essentially to the free height of the housing 3 which still exists in the state in which it is connected to further modules 1. This makes it possible to provide a particularly large-area printed circuit board 9, which can be held very firmly by the holder 5.

The printed circuit board 9 advantageously has recesses or holes 15 in which the latching tabs 10 engage and advantageously fix the printed circuit board 9. In contrast to this, the printed circuit board 9 shown in FIG. 3 has projections 13, which provide the latching with the latching tabs 10. The significant feature with regard to latching by means of the latching tabs 10 is the capability to grip behind a section of the printed circuit board 9.

Furthermore, electrical connections 14 are illustrated in FIG. 6 or 8. The connections 14, which are in the form of spring contacts 14, can make contact at the end not only with the printed circuit board 9 but also with the incandescent bulb 7.

As can be seen particularly clearly in FIG. 6, in contrast to the variant of the invention shown in FIGS. 1 to 4, the recesses 8 or slots 8 for the printed circuit board 9 in the second variant of the invention are arranged rotated through approximately 90° with respect to the bayonet fitting 12 on the incandescent bulb 7. This means that the standard connections of the incandescent bulb 7 and the end connections of the printed circuit board 9 are connected to the connections 14 while in the installed state.

In general, in the case of the module 1 as shown in FIGS. 5 to 8, an incandescent bulb 7 can be fixed to and detached from the bayonet fitting 12 comparatively easily. In contrast, in this variant of the invention, the printed circuit board is fixed relatively easily and is inserted into the holder 5, but this reliably prevents the printed circuit board 9 from being removed easily. These characteristics of the holder 5 take account of the fact that, for example, incandescent bulbs 7 in general have a considerably shorter life than electronic components and LEDs which are arranged as light-emitting means on the printed circuit board.

One particularly advantageous feature of the invention is that it has resulted in a multifunctional module 1 or signaling appliance which can be equipped in an extremely flexible manner with widely differing functional components while having only one base module 1 or signaling appliance, and at the same time can be matched to widely differing applications, and in which case the electronics mount 9 or printed circuit board 9 can be installed very easily, as in the case of commercially available signaling elements 7 or incandescent bulbs 7.

What is claimed is:

1. A signaling appliance for indicating at least one operating state of an appliance said signaling appliance having at least one holding apparatus (5) for holding an electrical signaling element (7), wherein the improvement comprises a holding apparatus (5) having a combined signal element opening for holding a signaling element or an electronics mount, said combined signal element opening having a signal element opening and a lateral guide apparatus opening (8) in the form of an axial recess in direct contact with and in alignment with said signal element opening in said holding apparatus (5) said lateral guide apparatus opening providing for lateral guidance and holding of an electronics mount (9) in alignment with and inside said combined signal element opening in said holding apparatus.

2. The signaling appliance according to claim 1 wherein said holding apparatus (5) of the signaling element (7) and the electronics mount (9) have different holding elements.

3. The signaling appliance according to claim 1 wherein the lateral guide opening (8) allows the electronics mount (9) to be plugged into the holding apparatus (5).

4. The signaling appliance according to claim 1 wherein the lateral guide apparatus (8) is a slot (8) open on at least one side.

5. The signaling appliance according to claim 4 wherein the slot (8) is aligned essentially in the axial direction of the signaling appliance (1).

6. The signaling appliance according to claim 4 wherein the slot (8) is open on that side of the holding apparatus (5) which is arranged opposite a base (4).

7. The signaling appliance according to claim 1 wherein the electronics mount (9) is broader than the holding apparatus (5).

8. The signaling appliance according to claim 1 wherein the width of the electronics mount (9) corresponds essentially to the unobstructed width of the signaling appliance cross section.

9. The signaling appliance according to claim 1 wherein the electronics mount (9) has at least one light-emitting diode.

10. The signaling appliance according to claim 1 further comprising at least one fixing unit (10) for fixing the signaling element (7) or the electronics mount (9).

11. The signaling appliance according to claim 10 wherein the fixing unit (10) is a latching unit (10) for latching of the signaling element (7) or the electronics mount (9).

12. The signaling appliance according to claim 10 or 11 wherein the fixing unit (10) has at least one bayonet fitting (12) for fixing the signaling element (7) or the electronics mount (9).

13. The signaling appliance according to claim 1 wherein identical electrical connections (2, 14) are used for the power supply or for interchanging data for both the signaling element (7) and the electronics mount (9).

14. The signaling appliance according to claim 1 further comprising electrical contact connections (2, 14) wherein said connections are spring contacts (14).

15. The signaling appliance according to claim 1 wherein the electronics mount (9) has at least one transmitting unit with a transmitter and/or a receiver for wire-free data transmission to a receiver and/or from a transmitter.

16. The signaling appliance according to claim 1 wherein the electronics mount (9) has at least one bus coupler.

17. The signaling appliance according to claim 1 wherein the electronics mount (9) has at least one sensor for recording a parameter.

18. The signaling appliance according to claim 1 wherein the electronics mount is a printed circuit board (9) wherein said circuit board has at least one image recording unit for recording an image or of moving images.

19. The signaling appliance according to claim 1 further comprising at least one electrical tone generator to produce tones.

20. A signaling device comprising:

(a) a signaling column housing for housing an electrical signaling element;

(b) a dual function holding apparatus disposed in said signaling column housing, said dual function holding apparatus having an integrated signal lamp opening with an electronic mount opening, said electronic mount opening having an axial recess in said dual function holding apparatus for holding and providing electrical contact for a signal lamp or a circuit board disposed within said axial recess within said dual function holding apparatus, said electronic mount opening forming a part of said signal lamp opening to accept said circuit board within said axial recess and in parallel alignment with said axial recess; and (c) a circuit board electrical contact disposed in said dual function holding apparatus.

* * * * *